US011957211B2

(12) United States Patent
Kutylov

(10) Patent No.: US 11,957,211 B2
(45) Date of Patent: Apr. 16, 2024

(54) FOOTWEAR APPARATUS FOR FACILITATING OPTIMAL GAITING

(71) Applicant: Denis Kutylov, Celebration, FL (US)

(72) Inventor: Denis Kutylov, Celebration, FL (US)

( * ) Notice: Subject to any disclaimer, the term of this patent is extended or adjusted under 35 U.S.C. 154(b) by 0 days.

(21) Appl. No.: 18/218,105

(22) Filed: Jul. 5, 2023

(65) Prior Publication Data

US 2023/0337786 A1 Oct. 26, 2023

(51) Int. Cl.
*A43B 21/40* (2006.01)
*A43B 21/48* (2006.01)

(52) U.S. Cl.
CPC ..... *A43B 21/40* (2013.01); *A43B 21/48* (2013.01)

(58) Field of Classification Search
CPC ..... A43B 21/40; A43B 21/48
USPC ..... 36/36 R, 36 C, 42
See application file for complete search history.

(56) References Cited

U.S. PATENT DOCUMENTS 1,479,421 A * 1/1924 Powell ..... A43B 21/40 36/36 R
3,646,497 A * 2/1972 Gillikin ..... A43B 21/39 36/58.5
4,610,100 A * 9/1986 Rhodes ..... A43B 21/39 36/36 A
4,949,476 A 8/1990 Anderie
5,692,322 A * 12/1997 Lombardino ..... A43B 5/00 36/36 A
5,694,706 A 12/1997 Penka
9,486,032 B2 * 11/2016 Morris Thill ..... A43B 3/246
2001/0052195 A1 * 12/2001 Blakey ..... A43B 21/50 36/15
2007/0256330 A1 * 11/2007 Wallin ..... A43B 21/42 36/102
2010/0101113 A1 * 4/2010 Paik ..... A43B 21/39 36/100
2017/0273400 A1 9/2017 Penka

OTHER PUBLICATIONS

FBR Concept, FBR NOA II Running shoe, FBR NOA I Running shoe, and Media, https://fbrconcept.com/en/, 4 pages as filed on Jan. 23, 2024.

* cited by examiner

*Primary Examiner* — Ted Kavanaugh
(74) *Attorney, Agent, or Firm* — Dhiraj Jindal; PATENT YOGI LLC

(57) ABSTRACT

Disclosed herein is a footwear apparatus for facilitating optimal gaiting, in accordance with some embodiments. Accordingly, the footwear apparatus includes an upper configured for retaining a foot of a user in the footwear apparatus. Further, the footwear apparatus includes a sole comprising a front portion and a rear portion. Further, the upper is attached to the sole. Further, the rear portion is raised away from a plane defined by the front portion. Further, the rear portion comprises a first attachment component. Further, the footwear apparatus includes a heel configured to be removably attached to the rear portion of the sole. Further, the heel comprises a second attachment component configured for mating with the first attachment component. Further, the removably attaching of the heel with the rear portion is based on the mating.

14 Claims, 12 Drawing Sheets

FOOTWEAR APPARATUS FOR FACILITATING OPTIMAL GAITING

FIELD OF THE INVENTION

Generally, the present disclosure relates to the field of boots, shoes, and leggings. More specifically, the present disclosure relates to a footwear apparatus for facilitating optimal gaiting.

BACKGROUND OF THE INVENTION

The field of boots, shoes, and leggings is technologically important to several industries, business organizations, and/or individuals. In particular, the use of boots, shoes, and leggings is prevalent for a footwear apparatuses for facilitating optimal gaiting.

In the modern world, running is the main form of public sport. At the same time, it has been known that poor running technique can harm the knee joints and spine. There are many recommendations and different methods for solving this problem. Moreover, the main one is to start each step not with the heel but with the forefoot. This rule is tricky to follow for ordinary individuals who are not athletes or experienced in running. Furthermore, cross-country running includes uphill running and downhill running. During uphill running, a runner always wants some support below the heel. In addition, during downhill running, the runner needs to have a smaller and longer heel to make steps more comfortable and avoid the pressure on fingers.

Therefore, there is a need for an improved footwear apparatus for facilitating optimal gaiting that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a footwear apparatus for facilitating optimal gaiting, in accordance with some embodiments. Accordingly, the footwear apparatus may include an upper. Further, the upper may include a layer configured to form a foot space. Further, the upper may be configured for retaining a foot of a user in the footwear apparatus. Further, the footwear apparatus may include a sole. Further, the sole may include a front portion and a rear portion. Further, the upper may be attached to the sole. Further, the rear portion may be raised away from a plane defined by the front portion. Further, the rear portion contacts a heel portion of the foot when the footwear apparatus may be worn on the foot. Further, the rear portion may include a first attachment component. Further, the footwear apparatus may include a heel configured to be removably attached to the rear portion of the sole. Further, the heel may include a second attachment component configured for mating with the first attachment component. Further, the removably attaching of the heel with the rear portion may be based on the mating.

Further disclosed herein is a footwear apparatus for facilitating optimal gaiting, in accordance with some embodiments. Accordingly, the footwear apparatus may include an upper. Further, the upper may include a layer configured to form a foot space. Further, the upper may be configured for retaining a foot of a user in the footwear apparatus. Further, the footwear apparatus may include a sole. Further, the sole may include a front portion and a rear portion. Further, the upper may be attached to the sole. Further, the rear portion may be raised away from a plane defined by the front portion. Further, the rear portion contacts a heel portion of the foot when the footwear apparatus may be worn on the foot. Further, the rear portion may include a first attachment component. Further, the footwear apparatus may include a heel configured to be removably attached to the rear portion of the sole. Further, the heel may include a second attachment component configured for mating with the first attachment component. Further, the removably attaching of the heel with the rear portion may be based on the mating. Further, the sole may include an interface region between the rear portion and the front portion. Further, the interface region may be characterized by a stiffness value greater than that of each of the front portion and the rear portion excluding the interface region.

Further disclosed herein is a footwear apparatus for facilitating optimal gaiting, in accordance with some embodiments. Accordingly, the footwear apparatus may include an upper. Further, the upper may include a layer configured to form a foot space. Further, the upper may be configured for retaining a foot of a user in the footwear apparatus. Further, the footwear apparatus may include a sole. Further, the sole may include a front portion and a rear portion. Further, the upper may be attached to the sole. Further, the rear portion may be raised away from a plane defined by the front portion. Further, the rear portion contacts a heel portion of the foot when the footwear apparatus may be worn on the foot. Further, the rear portion may include a first attachment component. Further, the footwear apparatus may include a heel configured to be removably attached to the rear portion of the sole. Further, the heel may include a second attachment component configured for mating with the first attachment component. Further, the removably attaching of the heel with the rear portion may be based on the mating. Further, the first attachment component may include a catching component and the second attachment component may include a latching component. Further, the latching component may be configured for detachably latching with the catching component. Further, the removably attaching of the heel with the rear portion may be further based on the detachably latching. Further, the sole may include an interface region between the rear portion and the front portion. Further, the interface region may be characterized by a stiffness value greater than that of each of the front portion and the rear portion excluding the interface region.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
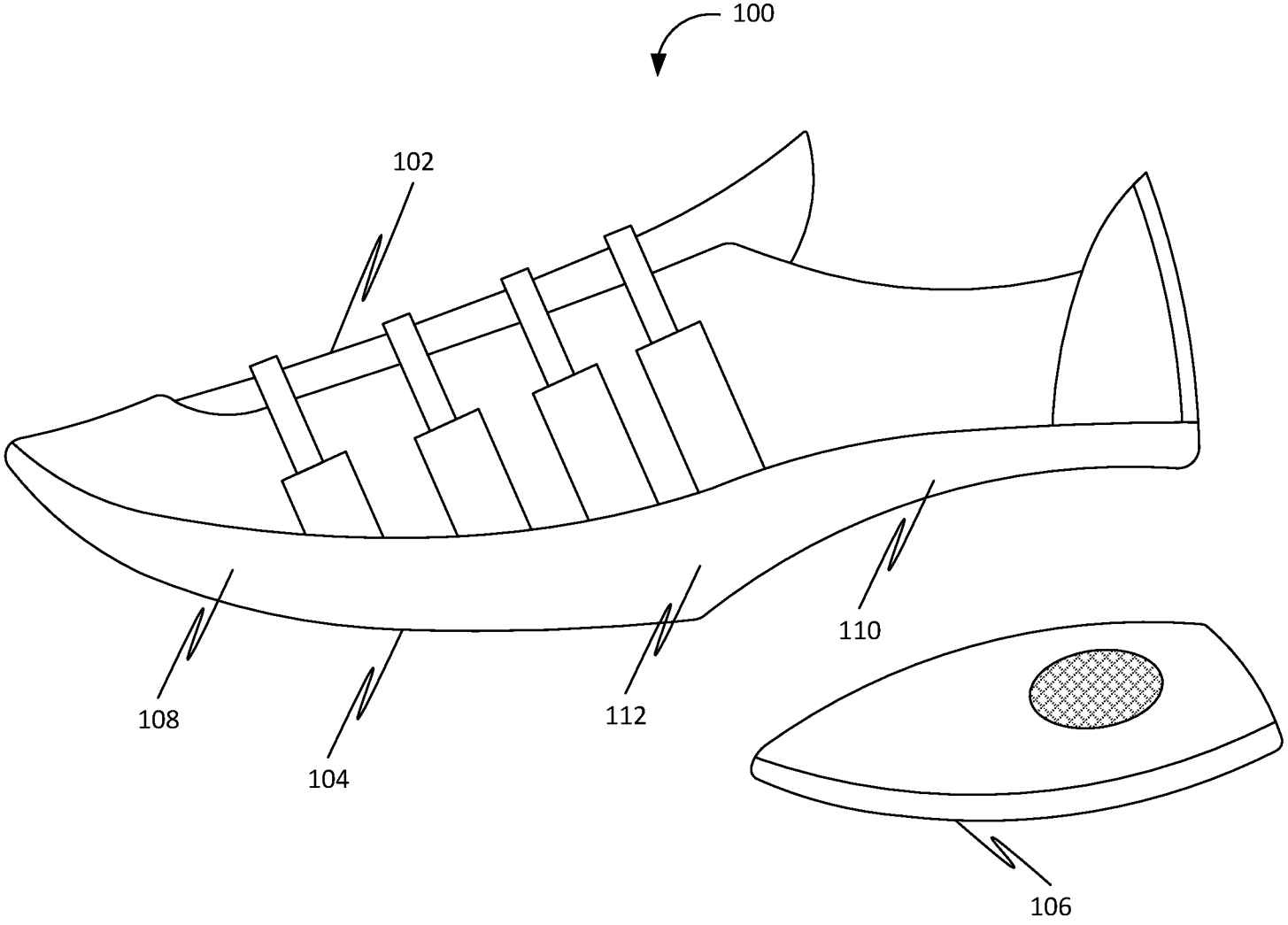
FIG. 1 is a disassembled side view of a footwear apparatus 100 for facilitating optimal gaiting, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a footwear apparatus for facilitating optimal gaiting, embodiments of the present disclosure are not limited to use only in this context.

Overview:

The present disclosure describes a footwear apparatus for facilitating optimal gaiting. Further, the disclosed footwear apparatus may include running shoes with a removable back of the sole (the heel). Further, when the heel is detached, the front part of the sole and its functionality may be preserved. Further, a foot of a user may be forced to be based on the front part of the sole because the heel may be hanging in the air. Further, the shape of the entire sole includes variable stiffness that is firmer towards the heel, to support the heel of the user while running. Further, the user may start every step with a forefoot, and the heels of the user may not get impacted from below while running. After running, the user may attach a heel to the sole for normal movement. Further, the removable heel may include a plurality of heights and lengths to provide a comfortable gaiting experience to the user during uphill running and downhill running.

Further, the present disclosure describes a footwear having a heel that is removably attached to a rear portion of a sole of the footwear and may be removably replaced with one of a plurality of heels associated with the footwear. Further, the plurality of heels includes the heel. Further, the each of the plurality of heels may be different and may enable and/or support different running techniques when attached to the footwear.

Further, the present disclosure describes a footwear apparatus which includes a pair of shoes having a pair of heels attached to the pair of shoes and a plurality of pair of heels. Further, the pair of heels may be removably replaced with a pair from the plurality of pair of heels.

Figure 2:
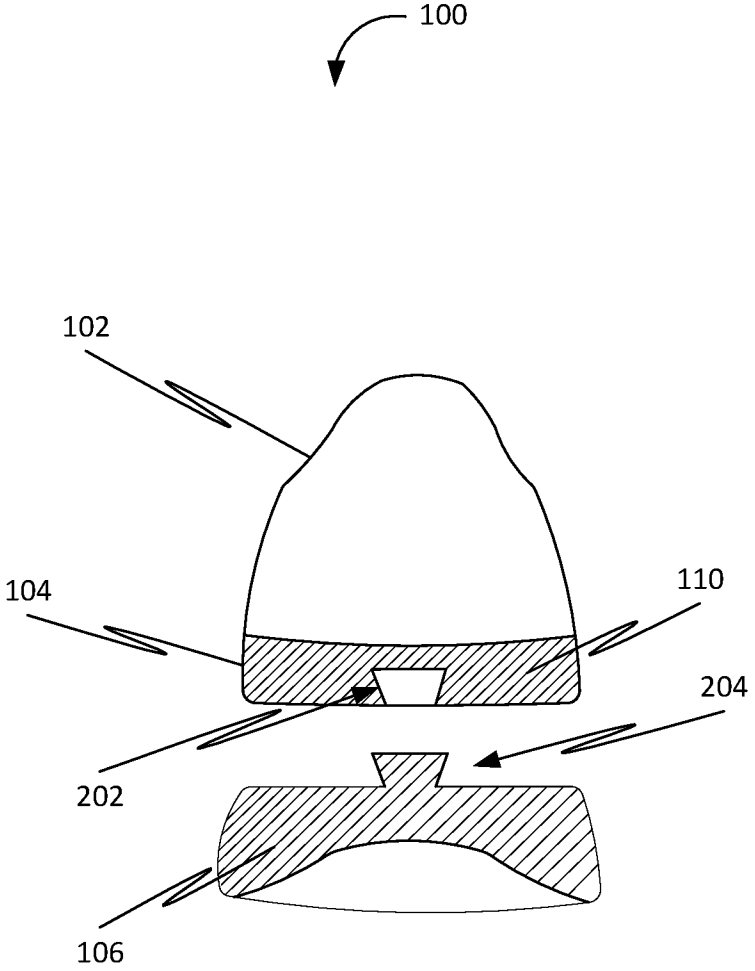
FIG. 2 is a disassembled rear view of the footwear apparatus 100, in accordance with some embodiments.

Referring now to figures, FIG. 1 is a disassembled side view of a footwear apparatus 100 for facilitating optimal gaiting, in accordance with some embodiments. Accordingly, the footwear apparatus 100 may include an upper 102. Further, the upper 102 may include a layer configured to form a foot space. Further, the upper 102 may be configured for retaining a foot of a user in the footwear apparatus 100. Further, the footwear apparatus 100 may include a sole 104. Further, the sole 104 may include a front portion 108 and a rear portion 110. Further, the upper 102 may be attached to the sole 104. Further, the rear portion 110 may be raised away from a plane defined by the front portion 108. Further, the rear portion 110 contacts a heel portion of the foot when the footwear apparatus 100 may be worn on the foot. Further, the rear portion 110 may include a first attachment component 202, as shown in FIG. 2. Further, the footwear apparatus 100 may include a heel 106 configured to be removably attached to the rear portion 110 of the sole 104. Further, the heel 106 may include a second attachment component 204, as shown in FIG. 2, configured for mating with the first attachment component 202. Further, the removably attaching of the heel 106 with the rear portion 110 may be based on the mating. Further, in an embodiment, the removably attaching of the heel 106 with the rear portion 110 may be based on adhesively attaching the heel 106 with the rear portion 110. Further, in an embodiment, the removably attaching of the heel 106 with the rear portion 110 may be based on magnetically attaching the heel 106 with the rear portion 110.

Further, in some embodiments, the sole 104 may include an interface region 112 between the rear portion 110 and the front portion 108. Further, the interface region 112 may be characterized by a stiffness value greater than that of each of the front portion 108 and the rear portion 110 excluding the interface region 112.

Further, in some embodiments, each of the front portion 108 and the rear portion 110 may be characterized by a stiffness value configured to resist a bending moment around the interface region 112 between the rear portion 110 and the front portion 108.

Further, in some embodiments, the heel 106 may include a plurality of heels (602 and 702). Further, a first heel 602 of the plurality of heels (602 and 702) may be characterized by a first length and a first height. Further, a second heel 702 of the plurality of heels (602 and 702) may be characterized by a second length and a second height. Further, the first height may be larger with respect to the second height. Further, the second length may be larger with respect to the first length. Further, in an embodiment, the second height may be larger with respect to the first height. Further, the first length may be larger with respect to the second length. Further, the each of the plurality of heels (602 and 702) may be different and may enable and/or support different running techniques when attached to the footwear apparatus 100.

Figure 4:
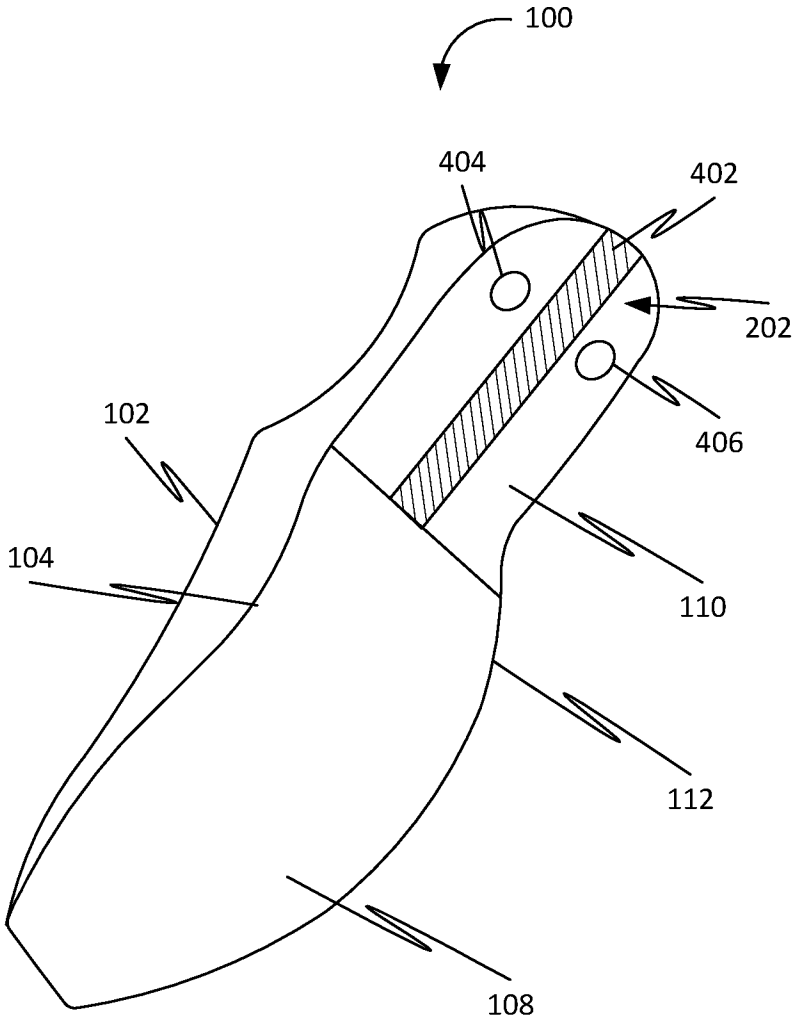
FIG. 4 is a bottom perspective view of the footwear apparatus 100 without the heel 106, in accordance with some embodiments.
Figure 5:
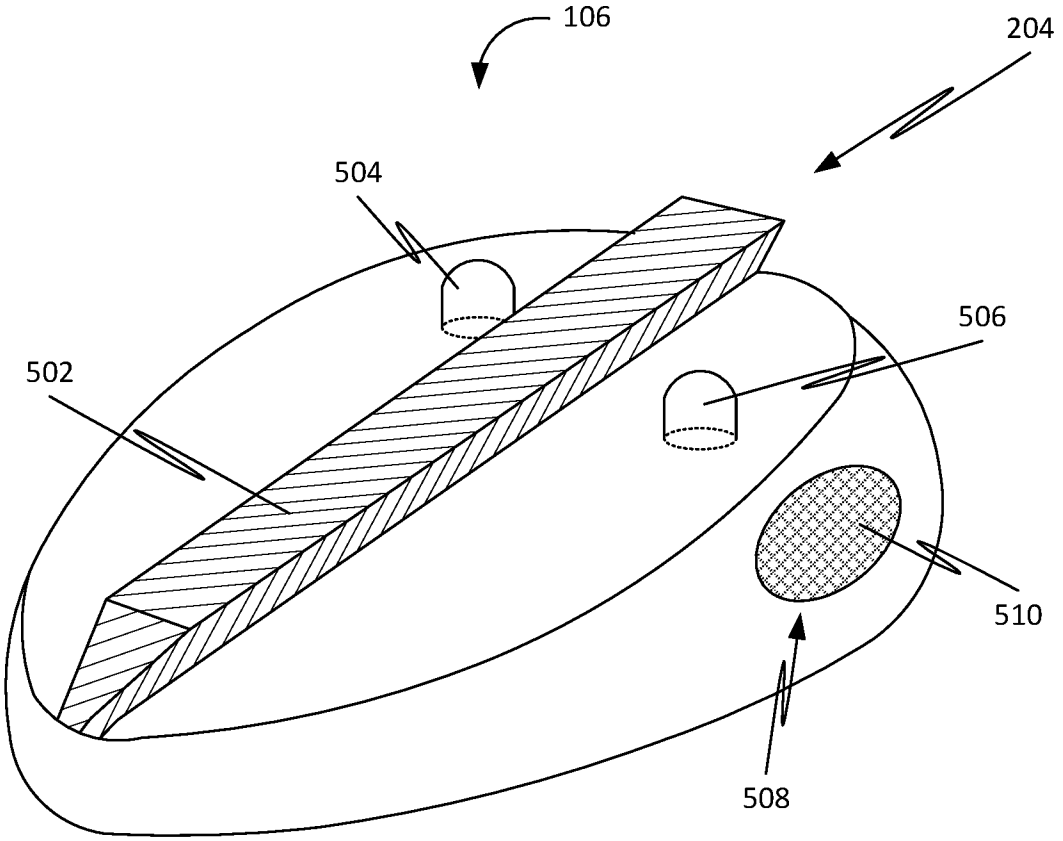
FIG. 5 is a top perspective view of the heel 106 of the footwear apparatus 100, in accordance with some embodiments.

Further, in some embodiments, the first attachment component 202 may include a slot 402, as shown in FIG. 4, characterized by a length. Further, the slot 402 may be disposed along a larger dimension on an underside of the rear portion 110. Further, the second attachment component 204 may include a key 502, as shown in FIG. 5, disposed on an overside of the heel 106. Further, the key 502 may be configured for slidingly mating with the slot 402 to form a joint for the removably attaching of the heel 106 with the rear portion 110. Further, the slidingly mating of the key 502 with the slot 402 restricts a relative motion between the heel 106 and the sole 104.

Further, in some embodiments, the first attachment component 202 may include a key (such as a key 814) disposed on an underside of the rear portion 110. Further, the second attachment component 204 may include a slot (such as a slot 906) characterized by a length. Further, the slot may be disposed along a larger dimension of an overside of the heel 106. Further, the key may be configured for slidingly mating with the slot to form a joint for the removably attaching of the heel 106 with the rear portion 110. Further, the slidingly mating of the key with the slot restricts a relative motion between the heel 106 and the sole 104.

Further, in some embodiments, the first attachment component 202 may include a receiving element 404-406, as shown in FIG. 4, and the second attachment component 204 may include a protruding element 504-506, as shown in FIG. 5, protruding out of the heel 106. Further, the protruding element 504-506 may be insertable in the receiving element 404-406. Further, the removably attaching of the heel 106 with the rear portion 110 may be based on inserting the protruding element 504-506 in the receiving element 404-406. Further, the inserting restricts a relative motion between the heel 106 and the sole 104.

Further, in some embodiments, the protruding element 504-506 may be retractably disposed in the heel 106. Further, the protruding element 504-506 may be transitionable between a released state and a caught state. Further, the receiving element 404-406 may be configured for receivingly catching the protruding element 504-506 based on the inserting. Further, the protruding element 504-506 may be receivingly caught by the receiving element 404-406 in the caught state. Further, the heel 106 may include a releasing mechanism 508 mechanically coupled with the protruding element 504-506. Further, the releasing mechanism 508 may include a releasing element 510, as shown in FIG. 5, configured for receiving at least one external action from the user. Further, the releasing element 510 may be a knob used to remove the heel 106 from the rear portion 110 of the sole 104. Further, the at least one external action may include a pressing action on the knob. Further, the releasing mechanism 508 may be configured for transitioning the protruding element 504-506 from the caught state to the released state by retracting the protruding element 504-506 inside the heel 106 based on the at least one external action. Further, the transitioning of the protruding element 504-506 may include retracting the protruding element 504-506 inside the heel 106. Further, the protruding element 504-506 may be released from the receiving element 404-406 based on the transitioning.

Further, in some embodiments, the releasing element 510 may be a push button configured for receiving at least one pushing action from the user. Further, the releasing mechanism 508 may be configured for transitioning the protruding element 504-506 from the caught state to the released state based on the at least one pushing action.

Further, in some embodiments, the heel 106 transitions from an unattached state to an attached state based on the mating. Further, in the attached state, a bottom surface of the front portion 108 and a bottom surface of the heel 106 may be in a common plane.

Further, in some embodiments, the first attachment component 202 may include a catching component and the second attachment component 204 may include a latching component. Further, the latching component may be configured for detachably latching with the catching component. Further, the removably attaching of the heel 106 with the rear portion 110 may be based on the detachably latching.

FIG. 2 is a disassembled rear view of the footwear apparatus 100, in accordance with some embodiments.

Figure 3:
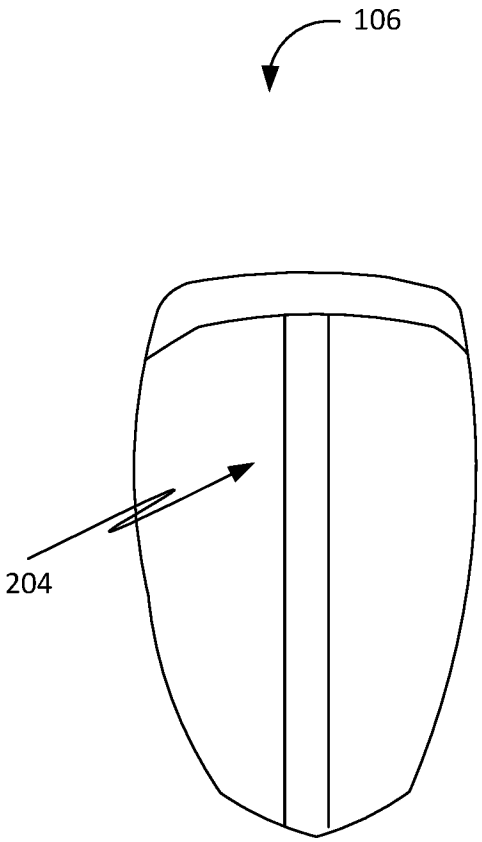
FIG. 3 is a top view of the heel 106 of the footwear apparatus 100, in accordance with some embodiments.

FIG. 3 is a top view of the heel 106 of the footwear apparatus 100, in accordance with some embodiments.

FIG. 4 is a bottom perspective view of the footwear apparatus 100 without the heel 106, in accordance with some embodiments.

FIG. 5 is a top perspective view of the heel 106 of the footwear apparatus 100, in accordance with some embodiments.

Figure 6:
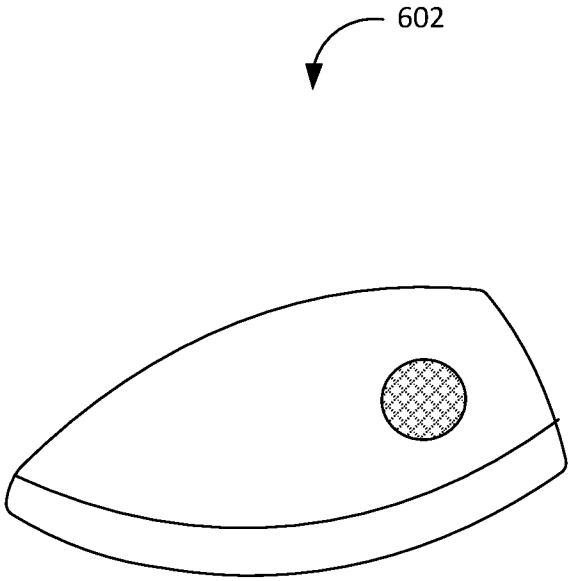
FIG. 6 is a side view of the first heel 602 of the plurality of heels (602 and 702) of the footwear apparatus 100, in accordance with some embodiments.

FIG. 6 is a side view of the first heel 602 of the plurality of heels (602 and 702) of the footwear apparatus 100, in accordance with some embodiments.

Figure 7:
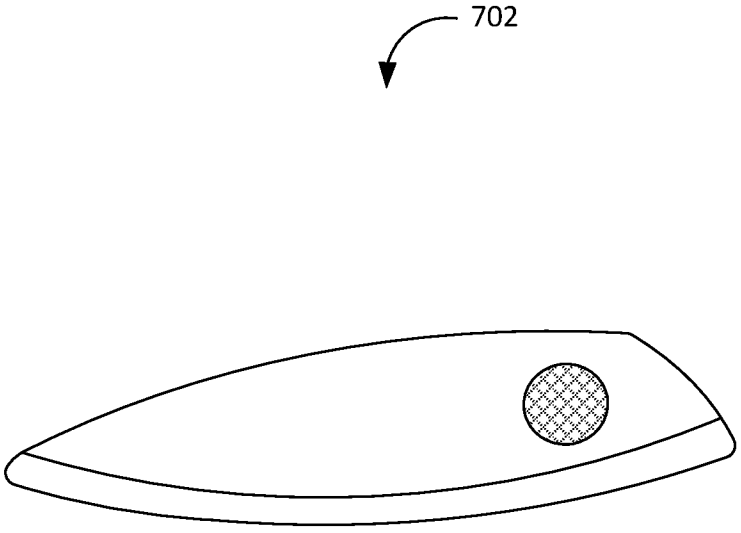
FIG. 7 is a side view of the second heel 702 of the plurality of heels (602 and 702) of the footwear apparatus 100, in accordance with some embodiments.

FIG. 7 is a side view of the second heel 702 of the plurality of heels (602 and 702) of the footwear apparatus 100, in accordance with some embodiments.

Figure 8:
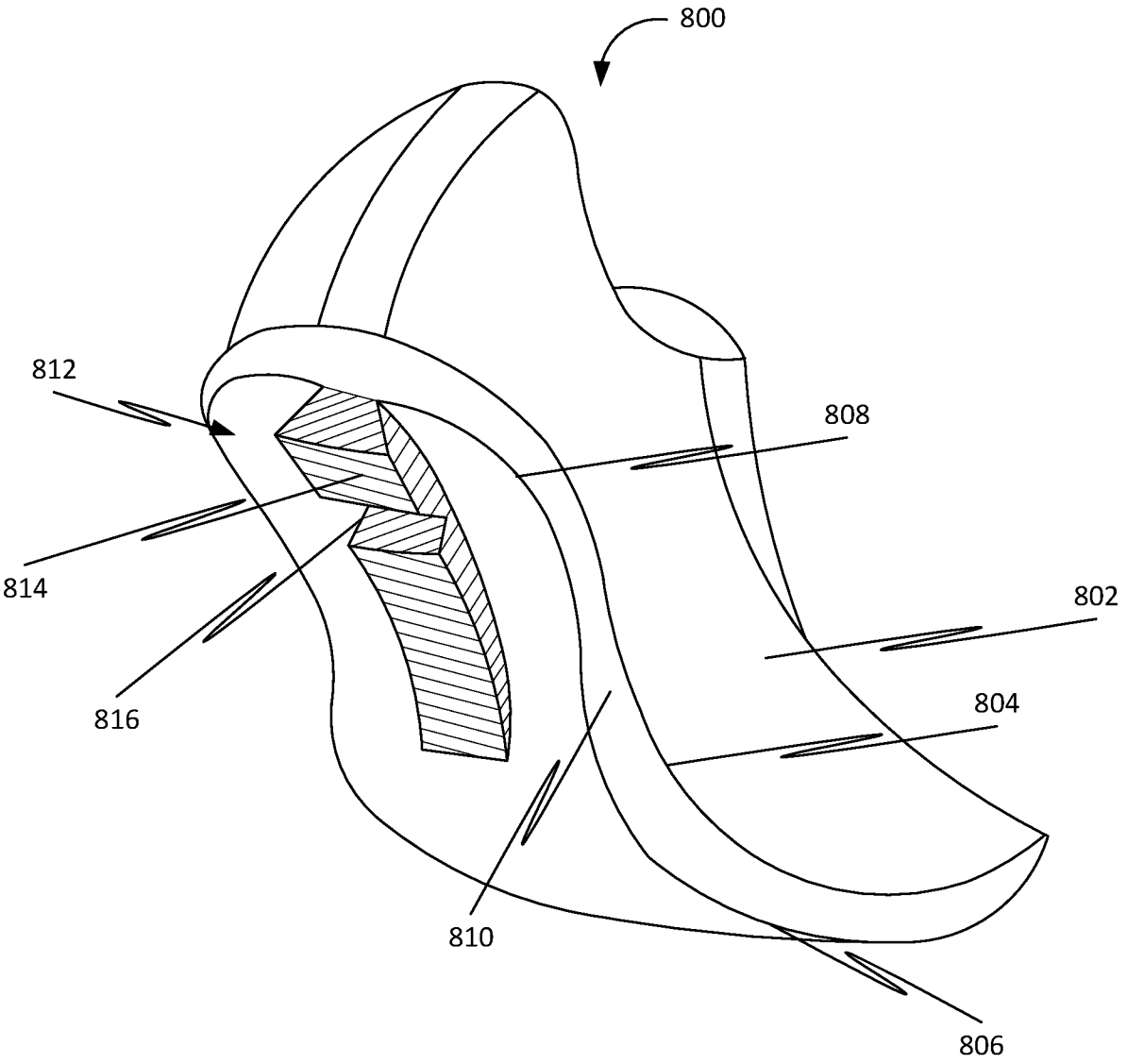
FIG. 8 is a perspective view of a footwear apparatus 800 for facilitating optimal gaiting, in accordance with some embodiments.

FIG. 8 is a perspective view of a footwear apparatus 800 for facilitating optimal gaiting, in accordance with some embodiments. Further, the footwear apparatus 800 may include an upper 802 and a sole 804. Further, the sole 804 may include a front portion 806, a rear portion 808, and an interface region 810 between the front portion 806 and the rear portion 808. Further, the rear portion 808 may be raised away from a plane defined by the front portion 806. Further, the rear portion 808 contacts a heel portion of the foot when the footwear apparatus 800 may be worn on the foot. Further, the rear portion 808 may include a first attachment component 812. Further, the first attachment component 812 may include a key 814 disposed on an underside of the rear portion 808.

Figure 9:
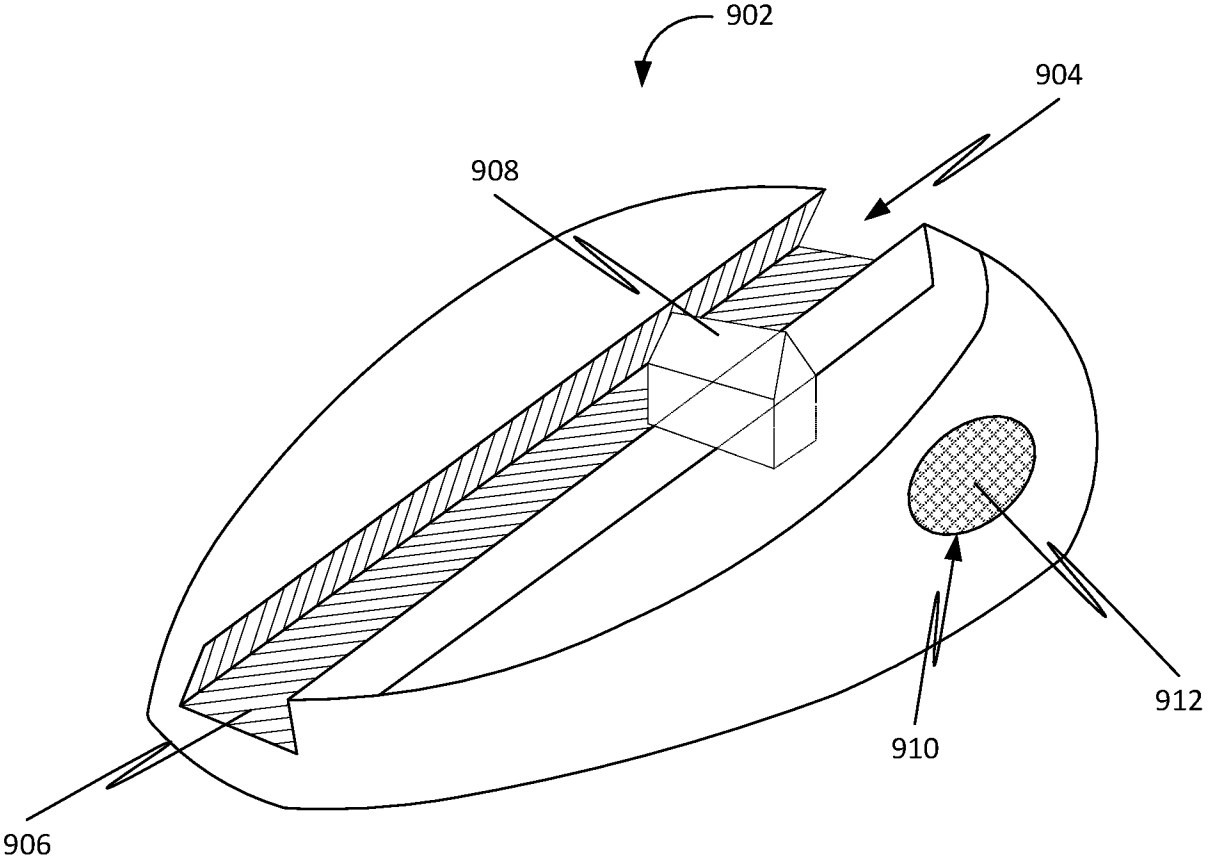
FIG. 9 is a top perspective view of a heel 902 of the footwear apparatus 800, in accordance with some embodiments.

FIG. 9 is a top perspective view of a heel 902 of the footwear apparatus 800, in accordance with some embodiments. Further, the heel 902 may be configured to be removably attached to the rear portion 808 of the sole 804. Further, the heel 902 may include a second attachment component 904 configured for mating with the first attachment component 812. Further, the removably attaching of the heel 902 with the rear portion 808 may be based on the mating. Further, the second attachment component 904 may include a slot 906 characterized by a length. Further, the slot 906 may be disposed along a larger dimension of an overside of the heel 902. Further, the key 814 may be configured for slidingly mating with the slot 906 to form a joint for the removably attaching of the heel 902 with the rear portion 808. Further, the slidingly mating of the key 814 with the slot 906 restricts a relative motion between the heel 902 and the sole 804.

Further, in some embodiments, the first attachment component 812 may include a receiving element 816 comprised in the key 814. Further, the second attachment component 904 may include a protruding element 908 comprised in the slot 906. Further, the protruding element 908 may be a lock knob. Further, the protruding element 908 may be configured to be inserted in the receiving element 816 for removably attaching the heel to the rear portion 808. Further, the protruding element 908 may be retractably disposed in the heel 106. Further, the protruding element 908 may be transitionable between a released state and a caught state. Further, the receiving element 816 may be configured for receivingly catching the protruding element 908 based on inserting the protruding element 908 in the receiving element 816. Further, the protruding element 908 may be receivingly caught by the receiving element 816 in the caught state. Further, the heel 902 may include a releasing mechanism 910 mechanically coupled with the protruding element 908. Further, the releasing mechanism 910 may include a releasing element 912 configured for receiving at least one external action from the user. Further, the releasing mechanism 910 may be configured for transitioning the protruding element 908 from the caught state to the released state by retracting the protruding element 908 inside the heel 902 based on the at least one external action. Further, the protruding element 908 may be released from the receiving element 816 based on the transitioning.

Figure 10:
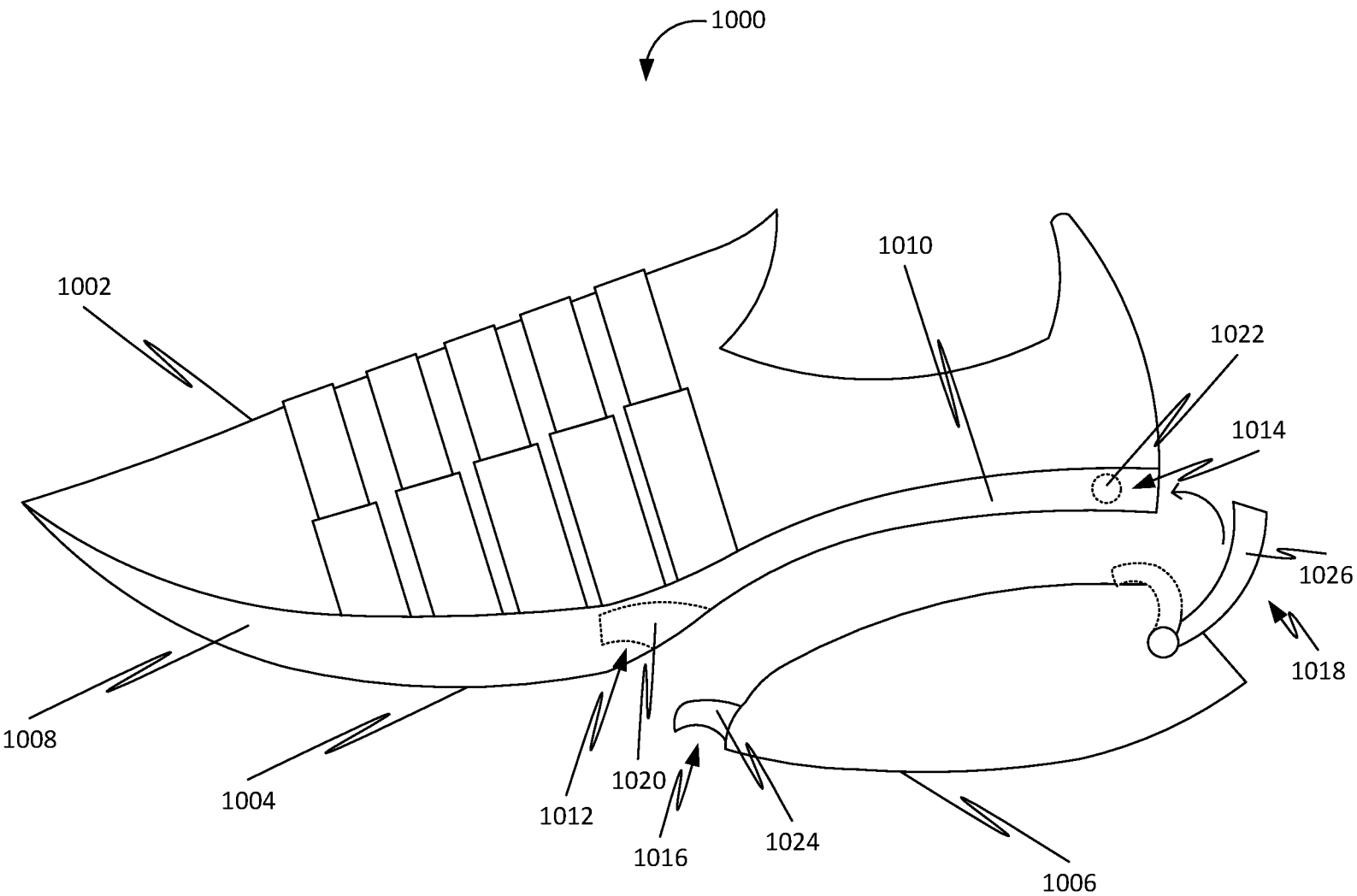
FIG. 10 is a disassembled side view of a footwear apparatus 1000 for facilitating optimal gaiting, in accordance with some embodiments.

FIG. 10 is a disassembled side view of a footwear apparatus 1000 for facilitating optimal gaiting, in accordance with some embodiments. Further, the footwear apparatus 400 may include an upper 1002, a sole 1004, and a heel 1006. Further, the sole 1004 may include a front portion 1008 and a rear portion 1008. Further, the rear portion 1010 may be raised away from a plane defined by the front portion 1008. Further, the rear portion 1010 contacts a heel portion of the foot when the footwear apparatus 1000 may be worn on the foot. Further, the rear portion 1010 may include a first attachment component 1012-1014. Further, the heel 1006 may include a second attachment component 1016-1018 configured for mating with the first attachment component 1012-1014. Further, the removably attaching of the heel 1006 with the rear portion 1010 may be based on the mating. Further, the first attachment component 1012-1014 may include a catching component 1020-1022 and the second attachment component 1016-1018 may include a latching component 1024-1026. Further, the latching component 1024-1026 may be configured for detachably latching with the catching component 1020-1022. Further, the removably attaching of the heel 1006 with the rear portion 1010 may be based on the detachably latching. Further, in an embodiment, a secondary latching component 1026 of the latching component 1024-1026 may be pivotally coupled with the heel 1006. Further, the secondary latching component 1026 may pivot between a first position and at least one second position. Further, the secondary latching component 1026 may be inserted into a secondary catching component 1022 of the catching component 1020-1022 in the first position. Further, the secondary latching component 1026 may be removed from the secondary catching component 1022 in the at least one second position. Further, the secondary latching component 1026 may be locked into the secondary catching component 1022 in the first position.

Figure 11:
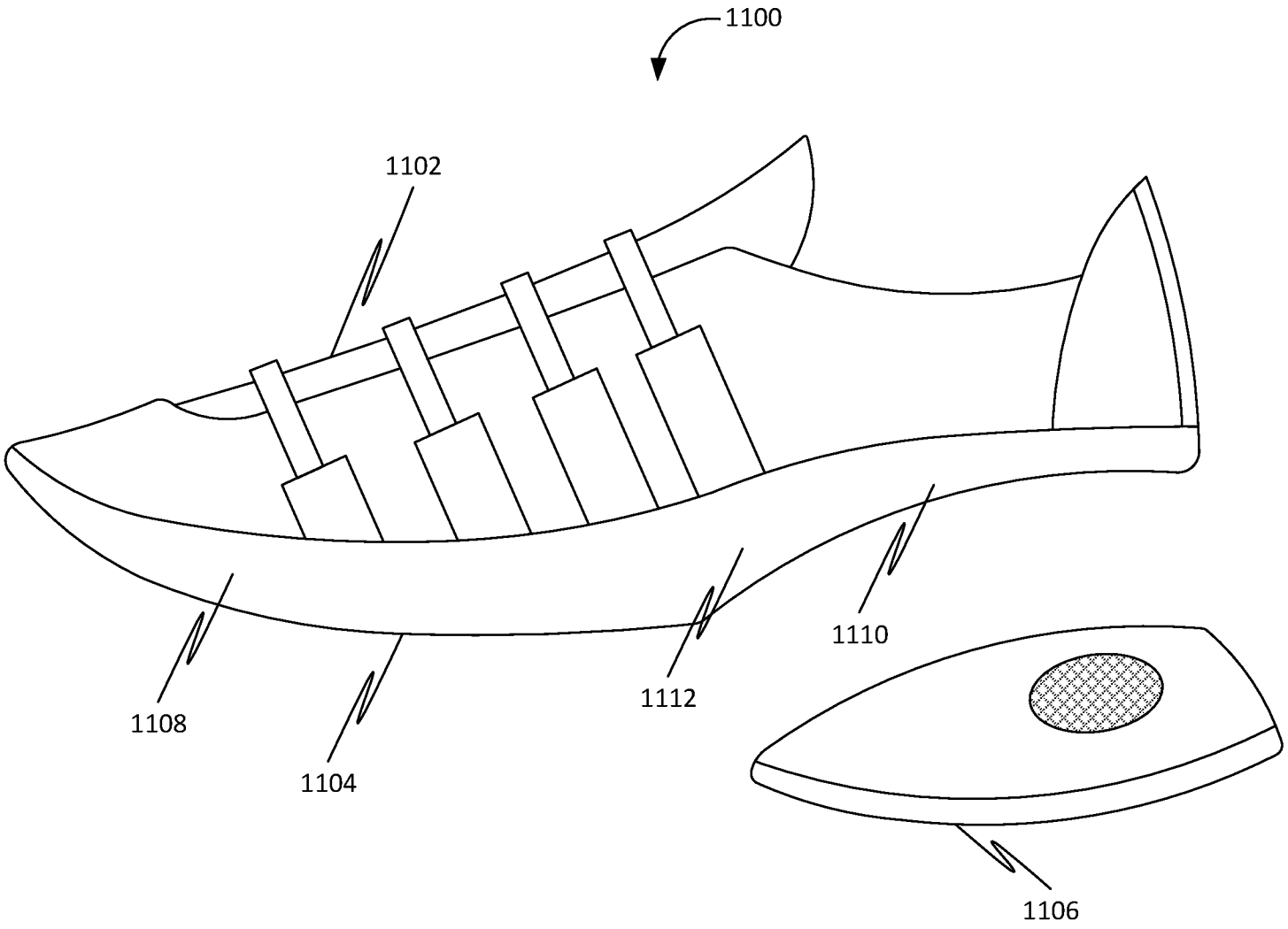
FIG. 11 is a disassembled side view of a footwear apparatus 1100 for facilitating optimal gaiting, in accordance with some embodiments.

FIG. 11 is a disassembled side view of a footwear apparatus 1100 for facilitating optimal gaiting, in accordance with some embodiments. Accordingly, the footwear apparatus 1100 may include an upper 1102. Further, the upper 1102 may include a layer configured to form a foot space. Further, the upper 1102 may be configured for retaining a foot of a user in the footwear apparatus 1100. Further, the footwear apparatus 1100 may include a sole 1104. Further, the sole 1104 may include a front portion 1108 and a rear portion 1110. Further, the upper 1102 may be attached to the sole 1104. Further, the rear portion 1110 may be raised away from a plane defined by the front portion 1108. Further, the rear portion 1110 contacts a heel portion of the foot when the footwear apparatus 1100 may be worn on the foot. Further, the rear portion 1110 may include a first attachment component. Further, the footwear apparatus 1100 may include a heel 1106 configured to be removably attached to the rear portion 1110 of the sole 1104. Further, the heel 1106 may include a second attachment component configured for mating with the first attachment component. Further, the removably attaching of the heel 1106 with the rear portion 1110 may be based on the mating. Further, the sole 1104 may include an interface region 1112 between the rear portion 1110 and the front portion 1108. Further, the interface region 1112 may be characterized by a stiffness value greater than that of each of the front portion 1108 and the rear portion 1110 excluding the interface region 1112.

Further, in some embodiments, each of the front portion 1108 and the rear portion 1110 may be characterized by a stiffness value configured to resist a bending moment around the interface region 1112 between the rear portion 1110 and the front portion 1108.

Further, in some embodiments, the first attachment component may include a slot characterized by a length. Further, the slot may be disposed along a larger dimension on an underside of the rear portion 1110. Further, the second attachment component may include a key disposed on an overside of the heel 1106. Further, the key may be configured for slidingly mating with the slot to form a joint for the removably attaching of the heel 1106 with the rear portion 1110. Further, the slidingly mating of the key with the slot restricts a relative motion between the heel 1106 and the sole 1104.

Further, in some embodiments, the first attachment component may include a key disposed on an underside of the rear portion 1110. Further, the second attachment component may include a slot characterized by a length. Further, the slot may be disposed along a larger dimension of an overside of the heel 1106. Further, the key may be configured for slidingly mating with the slot to form a joint for the removably attaching of the heel 1106 with the rear portion 1110. Further, the slidingly mating of the key with the slot restricts a relative motion between the heel 1106 and the sole 1104.

Further, in some embodiments, the heel 1106 transitions from an unattached state to an attached state based on the mating. Further, in the attached state, a bottom surface of the front portion 1108 and a bottom surface of the heel 1106 may be in a common plane.

Figure 12:
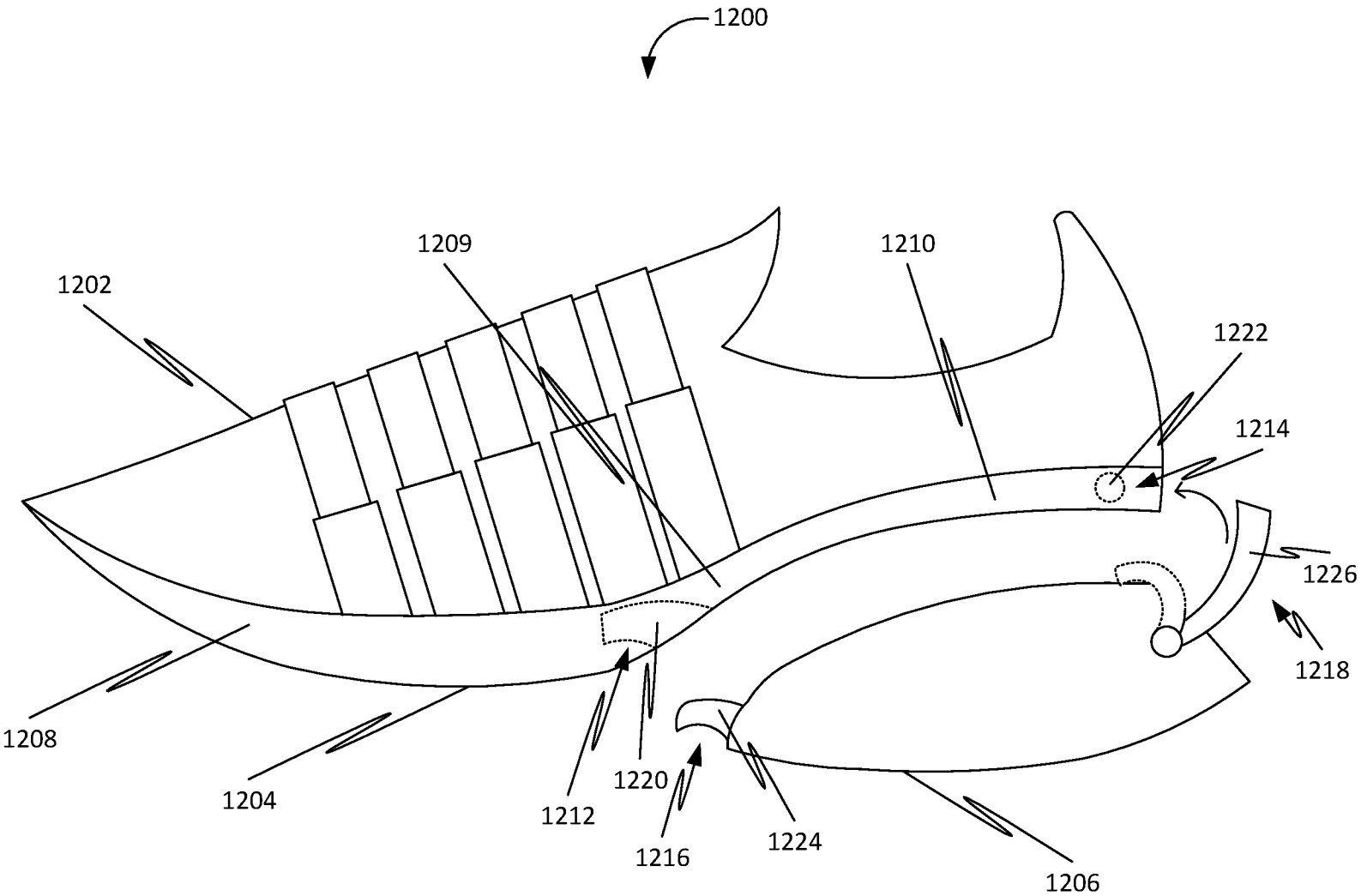
FIG. 12 is a perspective view of a footwear apparatus 1200 for facilitating optimal gaiting, in accordance with some embodiments.

FIG. 12 is a perspective view of a footwear apparatus 1200 for facilitating optimal gaiting, in accordance with some embodiments. Accordingly, the footwear apparatus 1200 may include an upper 1202. Further, the upper 1202 may include a layer configured to form a foot space. Further, the upper 1202 may be configured for retaining a foot of a user in the footwear apparatus 1200. Further, the footwear apparatus 1200 may include a sole 1204. Further, the sole 1204 may include a front portion 1208 and a rear portion 1210. Further, the upper 1202 may be attached to the sole 1204. Further, the rear portion 1210 may be raised away from a plane defined by the front portion 1208. Further, the rear portion 1210 contacts a heel portion of the foot when the footwear apparatus 1200 may be worn on the foot. Further, the rear portion 1210 may include a first attachment component 1212-1214. Further, the footwear apparatus 1200 may include a heel 1206 configured to be removably attached to the rear portion 1210 of the sole 1204. Further, the heel 1206 may include a second attachment component 1216-1218 configured for mating with the first attachment component 1212-1214. Further, the removably attaching of the heel 1206 with the rear portion 1210 may be based on the mating. Further, the first attachment component 1212-1214 may include a catching component 1220-1222 and the second attachment component 1216-1218 may include a latching component 1224-1226. Further, the latching component 1224-1226 may be configured for detachably latching with the catching component 1220-1222. Further, the removably attaching of the heel 1206 with the rear portion 1210 may be further based on the detachably latching. Further, the sole 1204 may include an interface region 1209 between the rear portion 1210 and the front portion 1208. Further, the interface region 1209 may be characterized by a stiffness value greater than that of each of the front portion 1208 and the rear portion 1210 excluding the interface region 1209.

Further, in some embodiments, each of the front portion 1208 and the rear portion 1210 may be characterized by a stiffness value configured to resist a bending moment around the interface region 1209 between the rear portion 1210 and the front portion 1208.

Further, in some embodiments, the heel 1206 transitions from an unattached state to an attached state based on the mating. Further, in the attached state, a bottom surface of the front portion 1208 and a bottom surface of the heel 1206 may be in a common plane.

Although the present disclosure has been explained in relation to its preferred embodiment, it is to be understood that many other possible modifications and variations can be made without departing from the spirit and scope of the disclosure.

The following is claimed:

1. A footwear apparatus for facilitating optimal gaiting, wherein the footwear apparatus comprises:

an upper comprising a layer configured to form a foot space, wherein the upper is configured for retaining a foot of a user in the footwear apparatus;

a sole comprising a front portion and a rear portion, wherein the upper is attached to the sole, wherein the rear portion is raised away from a plane defined by the front portion, wherein the rear portion contacts a heel portion of the foot when the footwear apparatus is worn on the foot, wherein the rear portion comprises a first attachment component; and a heel configured to be removably attached to the rear portion of the sole, wherein the heel comprises a second attachment component configured for mating with the first attachment component, wherein the removably attaching of the heel with the rear portion is based on the mating, wherein the sole is characterized by a stiffness, wherein the stiffness varies along the sole, wherein the stiffness of the rear portion is greater than the stiffness of the front portion, wherein the rear portion of the sole supports the heel portion of the foot of the user when the user runs while wearing the footwear apparatus without the heel, wherein a greater stiffness of the rear portion prevents an impact to the heel portion of the foot from an underside of the rear portion while running, wherein the sole comprises an interface region between the rear portion and the front portion, wherein the stiffness of the interface region is greater than that of each of the front portion and the rear portion excluding the interface region.

2. The footwear apparatus of claim 1, wherein the heel comprises a plurality of heels, wherein a first heel of the plurality of heels is characterized by a first length and a first height, wherein a second heel of the plurality of heels is characterized by a second length and a second height, wherein the first height is larger with respect to the second height, wherein the second length is larger with respect to the first length.

3. The footwear apparatus of claim 2, wherein the second height is larger with respect to the first height, wherein the first length is larger with respect to the second length.

4. The footwear apparatus of claim 1, wherein the first attachment component comprises a slot characterized by a length, wherein the slot is disposed along a larger dimension on an underside of the rear portion, wherein the second attachment component comprises a key disposed on an overside of the heel, wherein the key is configured for slidingly mating with the slot to form a joint for the removably attaching of the heel with the rear portion, wherein the slidingly mating of the key with the slot restricts a relative motion between the heel and the sole.

5. The footwear apparatus of claim 1, wherein the first attachment component comprises a key disposed on an underside of the rear portion, wherein the second attachment component comprises a slot characterized by a length, wherein the slot is disposed along a larger dimension of an overside of the heel, wherein the key is configured for slidingly mating with the slot to form a joint for the removably attaching of the heel with the rear portion, wherein the slidingly mating of the key with the slot restricts a relative motion between the heel and the sole.

6. The footwear apparatus of claim 1, wherein the first attachment component comprises a receiving element and the second attachment component comprises a protruding element protruding out of the heel, wherein the protruding element is insertable in the receiving element, wherein the removably attaching of the heel with the rear portion is based on inserting the protruding element in the receiving element, wherein the inserting restricts a relative motion between the heel and the sole.

7. The footwear apparatus of claim 6, wherein the protruding element is retractably disposed in the heel, wherein the protruding element is transitionable between a released state and a caught state, wherein the receiving element is configured for receivingly catching the protruding element based on the inserting, wherein the protruding element is receivingly caught by the receiving element in the caught state, wherein the heel further comprises a releasing mechanism mechanically coupled with the protruding element, wherein the releasing mechanism comprises a releasing element configured for receiving at least one external action from the user, wherein the releasing mechanism is configured for transitioning the protruding element from the caught state to the released state by retracting the protruding element inside the heel based on the at least one external action, wherein the protruding element is released from the receiving element based on the transitioning.

8. The footwear apparatus of claim 7, wherein the releasing element comprises a push button configured for receiving at least one pushing action from the user, wherein the releasing mechanism is configured for transitioning the protruding element from the caught state to the released state based on the at least one pushing action.

9. The footwear apparatus of claim 1, wherein the heel transitions from an unattached state to an attached state based on the mating, wherein in the attached state, a bottom surface of the front portion and a bottom surface of the heel are in a common plane.

10. The footwear apparatus of claim 1, wherein the first attachment component comprises a catching component and the second attachment component comprises a latching component, wherein the latching component is configured for detachably latching with the catching component, wherein the removably attaching of the heel with the rear portion is further based on the detachably latching.

11. A footwear apparatus for facilitating optimal gaiting, wherein the footwear apparatus comprises:

an upper comprising a layer configured to form a foot space, wherein the upper is configured for retaining a foot of a user in the footwear apparatus;

a sole comprising a front portion and a rear portion, wherein the upper is attached to the sole, wherein the rear portion is raised away from a plane defined by the front portion, wherein the rear portion contacts a heel portion of the foot when the footwear apparatus is worn on the foot, wherein the rear portion comprises a first attachment component; and a heel configured to be removably attached to the rear portion of the sole, wherein the heel comprises a second attachment component configured for mating with the first attachment component, wherein the removably attaching of the heel with the rear portion is based on the mating, wherein the sole is characterized by a stiffness, wherein the stiffness varies along the sole, wherein the stiffness of the rear portion is greater than the stiffness of the front portion, wherein the rear portion of the sole supports the heel portion of the foot of the user when the user runs while wearing the footwear apparatus without the heel, wherein a greater stiffness of the rear portion prevents an impact to the heel portion of the foot from an underside of the rear portion while running, wherein the sole comprises an interface region between the rear portion and the front portion, wherein the stiffness of the interface region is greater than that of each of the front portion and the rear portion excluding the interface region.

12. The footwear apparatus of claim 11, wherein the first attachment component comprises a slot characterized by a length, wherein the slot is disposed along a larger dimension on an underside of the rear portion, wherein the second attachment component comprises a key disposed on an overside of the heel, wherein the key is configured for slidingly mating with the slot to form a joint for the removably attaching of the heel with the rear portion, wherein the slidingly mating of the key with the slot restricts a relative motion between the heel and the sole.

13. The footwear apparatus of claim 11, wherein the first attachment component comprises a key disposed on an underside of the rear portion, wherein the second attachment component comprises a slot characterized by a length, wherein the slot is disposed along a larger dimension of an overside of the heel, wherein the key is configured for slidingly mating with the slot to form a joint for the removably attaching of the heel with the rear portion, wherein the slidingly mating of the key with the slot restricts a relative motion between the heel and the sole.

14. The footwear apparatus of claim 11, wherein the heel transitions from an unattached state to an attached state based on the mating, wherein in the attached state, a bottom surface of the front portion and a bottom surface of the heel are in a common plane.

* * * * *